United States Patent [19]

Sraitr et al.

[11] 4,322,944

[45] Apr. 6, 1982

[54] METHOD OF AND APPARATUS FOR BREAK SPINNING YARN

[75] Inventors: Stanislav Sraitr; Hana Srejberova, both of Frydlant, Czechoslovakia

[73] Assignee: Elitex, koncern textilniho strojirenstvi, Liberec, Czechoslovakia

[21] Appl. No.: 47,039

[22] Filed: Jun. 11, 1979

[30] Foreign Application Priority Data

| | | | |
|---|---|---|---|
| Jun. 12, 1978 | [CS] | Czechoslovakia | 3796-78 |
| Aug. 16, 1978 | [CS] | Czechoslovakia | 5325-78 |
| Aug. 16, 1978 | [CS] | Czechoslovakia | 5327-78 |

[51] Int. Cl.[3] ..... D02G 1/20; D01H 7/92

[52] U.S. Cl. ..... 57/328; 57/332; 57/333; 57/350

[58] Field of Search ..... 57/328, 329, 332, 333, 57/289, 290, 342, 345, 350

[56] References Cited

U.S. PATENT DOCUMENTS

| | | | |
|---|---|---|---|
| 3,706,192 | 12/1972 | Leibbrand et al. | 57/290 |
| 4,112,658 | 9/1978 | Morihashi | 57/328 |
| 4,141,121 | 2/1979 | Trifunovic | 57/333 |
| 4,183,202 | 1/1980 | Morihashi | 57/328 |

*Primary Examiner*—Donald Watkins

[57] ABSTRACT

Method of and apparatus for break spinning yarn in a spinning machine. A fiber ribbon is formed into a fiber ribbon, the ribbon is false twisted in a first twisting element, staple fiber ends are lifted from the false twisted ribbon in a second, re-spinning twist imparting element, the second element being driven in the same direction as but at a higher speen than the first element, the thus resulting spun yarn is given an additional, true twist, and is then wound on a bobbin.

30 Claims, 25 Drawing Figures

FIG-2
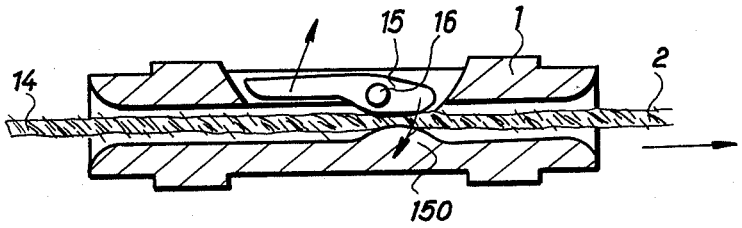
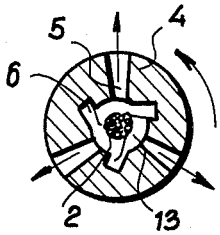
FIG-4
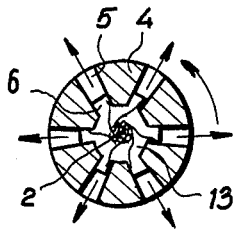
FIG-4A
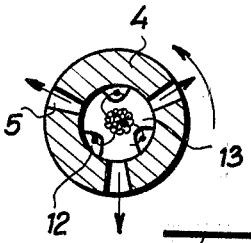
FIG-4B
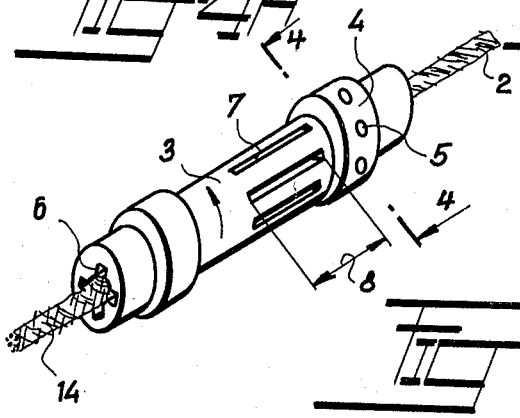
FIG-3
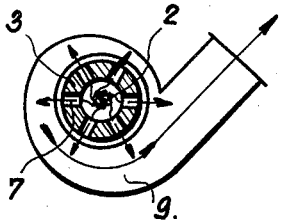
FIG-5

METHOD OF AND APPARATUS FOR BREAK SPINNING YARN

The present invention relates to a method of break spinning for manufacturing yarns in a spinning machine, and to an apparatus for performing said method.

Various systems of break spinning have been known for a long time, of which, for example, rotor spinning, the so-called open end spinning is the best known. In this system, separated staple fibers are fed to the sliding wall of the rotor and are sucked therefrom by underpressure into the spinning rotor which rotates at high speed. By centrifugal force, said separated fibers slide about the sliding surface in the direction towards the maximum inner diameter on which the parallelized fibers are deposited in the form of a ribbon situated inside collecting grooves of the spinning rotor and spun to the open end of the yarn already formed. Upon axial withdrawal, the fiber ribbon is twisted and is then wound onto a cross-wound bobbin.

The disadvantage of the said method consists in that the yarn strength of the open end spun yarn is lower by about 15 to 30 percent compared to that of conventional, ring spun yarn.

A further disadvantage consists in that this system of spinning is less suitable for higher counts and cannot be used for manufacturing combed yarns.

In a further known method of spinning staple fibers with a twisting device acting upon the fibers, the spinning process is performed by means of an electrostatic field which is formed between the feeding of separated staple fibers and a rotating input funnel. The electrostatic field straightens the fibers and transfers them into the rotating, twist imparting input funnel.

However, even in this method there are decisive disadvantages which affect the spinning process and the yarn quality unfavorably. Varying relative humidity affects the electrostatic field unfavorably; this causes yarn breakage and the consequent interruption of the spinning process.

A still further spinning method is known in which yarn is spun by means of an air vortex with a true twist.

The disadvantage of this method consists in its high air consumption, besides a considerably less twist, caused by the air vortex. It is also a disadvantage that the attachment of the separated fibers to the freely rotating yarn end in the air vortex is not always secured. Thus, a considerable part of the fibers is sucked off and must be considered wasted.

A further known yarn forming system which imparts true twist is the so-called DREF system, which has the disadvantage that it is applicable only to a limited extent, preferably for synthetic fibers and wool within the count range from 100 to 167 tex (No. 1 to 6).

Among the methods hitherto known, there are the ROTOFIL and REPCO systems, as well as the spindleless spinning method, in which the surface of the fiber ribbon is to be felted and thus reinforced by means of pressure air.

The present invention has among its objects the provision of a break spinning method and an apparatus for performing said method, which removes to a large extent the known disadvantages of the prior methods discussed above, continuously imparts a true twist to the fiber ribbon, and makes it possible to wind the yarn continuously onto a cross-wound bobbin.

The method according to the present invention includes the following technological steps:

(a) At least one fiber ribbon consisting of staple fibers parallelized in the direction of withdrawal, is continuously fed to each spinning unit of the spinning machine;

(b) To the staple fibers of the ribbon there is continuously imparted a false twist, by which their front ends are directed towards the direction of imparting the false twist, while their other ends are directed in the opposite direction;

(c) The ends of the fiber ribbon staple fibers with false twist are lifted from the fiber ribbon in the direction of imparting false twist, gripped, partly released from the fiber ribbon by unwinding in the direction of imparting false twist at a higher speed than the imparting of said false twist, rearranged and deposited in the direction of true twist on the fiber ribbon, the yarn thus formed gaining a further true twist by means of the still existing and regressively formed false twist.

The advantage of the present invention consists mainly in that a true twist can be imparted to the parallelized staple fiber ribbon without disturbing the parallelity thereof.

A further advantage consists in an extremely high yarn quality which highly surpasses the quality obtained by any hitherto known break spinning methods, and which at least equals the yarn quality obtained with ring spun yarn.

The yarn manufactured by the method according to the present invention surpasses the yarn manufactured in ring spinning machines in that it does not loop, since the fibers are enabled to rotate freely about their own axes upon forming yarn. Consequently any internal stress which otherwise would cause yarn looping is avoided.

A further advantage consists also in that according to the principle of the invention all types of yarn can be formed within the whole count range from combed yarns to bump yarns, because this spinning method can be easily modified for processing natural as well as synthetic staple fibers of different staple length.

It is particularly advantageous when the surface of the fiber ribbon with false twist is wrapped around by at least one further staple fiber ribbon.

It is further suitable that the twisting section has a length equal to the staple length of the staple fibers twisted by false twist.

It is recommended that the false twist imparting speed and the respinning speed be different and independently controllable.

It is further advantageous that the staple fibers of the staple fiber ribbon deposited externally have a longer or shorter staple length in comparison to the staple fibers of the inner ribbon. Consequently, it is possible to process simultaneously, e.g., long bast fibers together with short cotton fibers, or the like.

It is also reasonable that the inner fiber ribbon consists of filaments.

Further advantageous embodiments consist in that the ends of the staple fibers of a staple fiber ribbon twisted by false twist, or a fiber bunch, respectively, be lifted and gripped by means of a pressure fluid, or underpressure, or a rotating electrostatic field, as well as by various combinations of the above mentioned means.

It is particularly advantageous, when all substandard fibers released from the staple fiber ribbon, or the fiber bunch, respectively, are separated in the respinning twists imparting element, or gripped and fed to the yarn forming bunch of staple fibers.

The apparatus for performing the method according to the present invention has a yarn forming zone in which, in the direction of passage of the fiber ribbon, there is at least one respinning twist imparting element and in continuation a false twist imparting element surrounding the fiber ribbon, and both the respinning twist imparting element and the element for imparting false twist are rotatable individually and each separately in the same direction at different speeds.

It is particularly advantageous that the device performing the method according to the present invention can operate at very high speeds with low energy input, since only minimum masses are rotated. Consequently, the speed of manufacture of yarn can be also considerably increased.

According to an advantageous embodiment, the respinning twist imparting element may consist of a cylindrical body with an axial inner space with an inlet and an outlet opening, an inner body and means for lifting and gripping fibers being arranged in said inner space, at least one headpiece being arranged on the outer surface with circumferentially distributed ventilation openings, and on the outer surface of the headpiece shell there are distributed longitudinal openings, pressure air, respinning grooves, respinning grooves in the material forming the electrostatic charge, an electrostatic field and their combinations being useful as means for lifting and gripping fibers.

It is advantageous that the headpiece be arranged at the input opening and/or the output opening of the body, and that the longitudinal openings and respinning grooves in the respinning twist imparting element be interconnected by bores, and that their length be in accordance with the length of the substandard staple fibers of the fiber ribbon, or staple fiber bunch, respectively.

The arrangement according to the present invention also makes possible a continuous separation of short fibers and impurities, this method thus making it possible to eliminate the hitherto usual combing machines, and to make combed yarn even from slivers.

It is also advantageous that at least a part of the overall length of the respinning twist imparting element be surrounded by a given number of suction openings for pressure air which open into the inner space, the outer area of the suction openings being smaller by about 50 percent than the outer area of the openings for pressure air supply.

It is advantageous that the respinning twist imparting element be at least partially covered by a cylinder provided with radial openings.

A pressure air nozzle for preliminary twist can be advantageously located in front of the respinning twist imparting element, or the respinning twist imparting element may be made as a pressure air respinning twist imparting nozzle with stationary or rotating, blade-shaped baffles.

By means of those arrangements, it is possible to process even coarser staple fibers with a higher resistance towards imparting true twist.

It is particularly advantageous to make the respinning twist imparting element in the form of a magnetic spindle driven by friction discs.

It is recommended that inside the false twist imparting element for imparting false twist to the fiber ribbon, or the staple fiber bunch, respectively, there be provided a gripping element, swingable about a pin against a gripping surface, particularly a centrifugal gripper.

When an effective respinning twist by imparting false twist to a twisted fiber ribbon in the respinning region of the respinning element is to be secured by a pressure fluid flow, it is advantageous to make the respinning element in the form of a rotating respinning twist element provided with a respinning channel, which is arranged at a predetermined angle relative to the fiber ribbon in such manner that the direction of pressure fluid flow in the respinning channel crosses the direction of the fiber ribbon passing through the respinning twist element.

The advantage of this last arrangement consists particularly in that the rotating respinning twist element with its respinning channel is made in such manner that the direction of respinning relative to the fiber ribbon and the respinning pressure fluid flow in the respinning channel are optional and/or controllable independently of each other. The adjustable speed of rotation of the respinning twist element exclusively determines the angular velocity of the pressure fluid flow in the respinning channel. The actual respinning by twist imparting is performed by continuous optional variations of the direction of pressure fluid flowing upon the passing yarn forming fiber ribbon twisted by false twist, independently of the direction in which the pressure fluid flows in the respinning channel.

It is particularly advantageous that, during respinning twist imparting, there are either separated or returned to the yarn forming fiber ribbon, staple fibers of substandard length. The separated impurities are thereupon taken away by centrifugal force and removed by known means from the spinning unit.

In accordance with various embodiments of the invention, it is possible to process shorter staple lengths in a respinning channel with a longer respinning zone particularly when said zone is defined by at least one adjustable limiting element of the respinning zone, which must be shorter relative to the staple length of the spun staple fibers, so as not to influence unfavorably the strength of the fiber ribbon.

When the respinning channel is narrowed in its cross section in the direction of the pressure fluid flow, at least behind the respinning zone, the respun tougher staple fibers, e.g., synthetic fibers, unwound from the fiber ribbon are continuously tensioned in an advantageous manner by the increasing velocity of the pressure fluid flow in the respinning channel.

When the respinning channel is provided from the inlet opening in the direction of pressure fluid flow towards the fiber ribbon with a narrowed cross section, and in the direction from the fiber ribbon towards the outlet opening of the respinning channel with a widening cross section, staple fibers with a higher content of impurities can be processed, the narrowing cross section making possible a more intensive respinning and releasing of impurities, while the following widening cross section prevents clogging of the channel by the released impurities.

The pressure fluid flow caused by the rotating ventilation openings in the respinning channel provides for a very delicate processing of the fiber ribbon. This embodiment is particularly suitable for finer deniers and yarn counts.

The pressure fluid flow can form a closed cycle in an advantageous manner by means of using separating sections or deflecting sections, whereby the impurities in the fibers are separated by centrifugal force, while staple fibers of substandard length, released from the fiber ribbon, are brought back to the fiber ribbon.

The subject matter of a simple, cheap and reliable spinning unit, which can secure effective respinning by twist imparting for various textile fibers of fiber ribbons by rotative pressure fluid flow in an improved manner, consists particularly in that the respinning element and the false twist element of the spinning unit are formed as at least one respinning pressure nozzle, simultaneously imparting false twist, arranged with the outlet in the direction of the fiber ribbon passage and being provided with a pre-arranged auxiliary twist element in the respinning zone of the spinning unit, which controls during respinning the imparting of false twist, said auxiliary twist element being arranged in front of the respinning pressure nozzle, simultaneously imparting false twist at a shorter distance than the average staple length of the fiber ribbon, the pressure fluid outlet of the respinning pressure nozzle simultaneously imparting a false twist, opening into a collecting space of a suction box.

It is advantageous for long staple fibers, when the spinning unit is provided with at least two, particularly cylindrical, respinning pressure nozzles arranged behind each other and gradually widening, which simultaneously impart false twist and operate independently in the same flowing directions. By this advantageous embodiment, the decreasing respinning rotation of the pressure fluid can be successively eaccelerated, and thus even the longest staple fiber are thus respun.

It is particularly advantageous, when the auxialiary twister which is prearranged and directed against the direction of passage of the fiber ribbon, and the respinning pressure nozzle imparting simultaneously false twist, are formed as a unitary pressure spinning unit from a tube, divided by a transversal wall provide in its center with an opening for the yarn, and tangentially arranged pressure fluid supplies. By this advantageous embodiment, any mechanical loading of the fiber ribbon is prevented and the respun fiber ribbon comes into contact only with the pressure fluid flow; this is very advantageous for the finest yarns. This advantageous embodiment makes it possible also to provide a very cheap, advantageous, and simple manufacture of spinning units, as the fiber ribbon is respun by the appurtenant pressure fluid flow to yarn substantially only inside said tube.

It is also advantageous when a limiting element of the respinning zone is arranged opposite the outlet of the pressure fluid of the respinning pressure nozzle simultaneously imparting false twist, said limiting element defining the respinning zone in a controllable manner and at the same time constituting a yarn threading mechanism which telescopically engages the respinning pressure nozzle which simultaneously imparts false twist by means of an arranged return spring as far as the transverse wall thereof, so that the spinning unit can be easily modified to various staple lengths of the fiber ribbon and yarn threading is made possible upon resumption of the spinning process.

A further advantage of the spinning unit according to the present invention consists in that for respinning there can be used a gas as well as a liquid. This embodiment can be advantageously used, when using liquid as the pressure fluid, even for wet spinning, particularly for processing bast fibers, manufacturing carpet yarns, etc., the suction box having to be arranged on the one hand at the outlet of the pressure fluid of the respinning pressure nozzle which simultaneously imparts false twist, and on the other hand at the outlet of the pressure fluid of the auxiliary twisting element.

It is also advantageous that the inner surface of the respinning pressure nozzle which simultaneously imparts false twist be made of hard, wear-resistant sintered ceramic material, for the purpose of avoiding wear by abrasion caused by the rotatably sliding fiber ends of the fiber ribbon.

The present invention is illustrated in the form of exemplary embodiments in the accompanying drawings, in which:

FIG. 2 is a view in longitudinal section through the false twist imparting element;

FIG. 3 is a view in perspective of the respinning twist imparting element provided with longitudinal openings;

FIG. 4 is a cross section view of the headpiece of the respinning twist element taken along line 4—4 in FIG. 3;

FIGS. 4A and 4B are views similar to FIG. 4 of two additional embodiments, respectively, of the headpiece of the respinning twist element;

FIG. 5 is a view in cross section through the embodiment of the respinning twist imparting element which is provided with an underpressure sleeve for the central sucking off of short fibers;

The same reference characters are employed throughout the several views to designate the same or similar elements.

Figure 1:
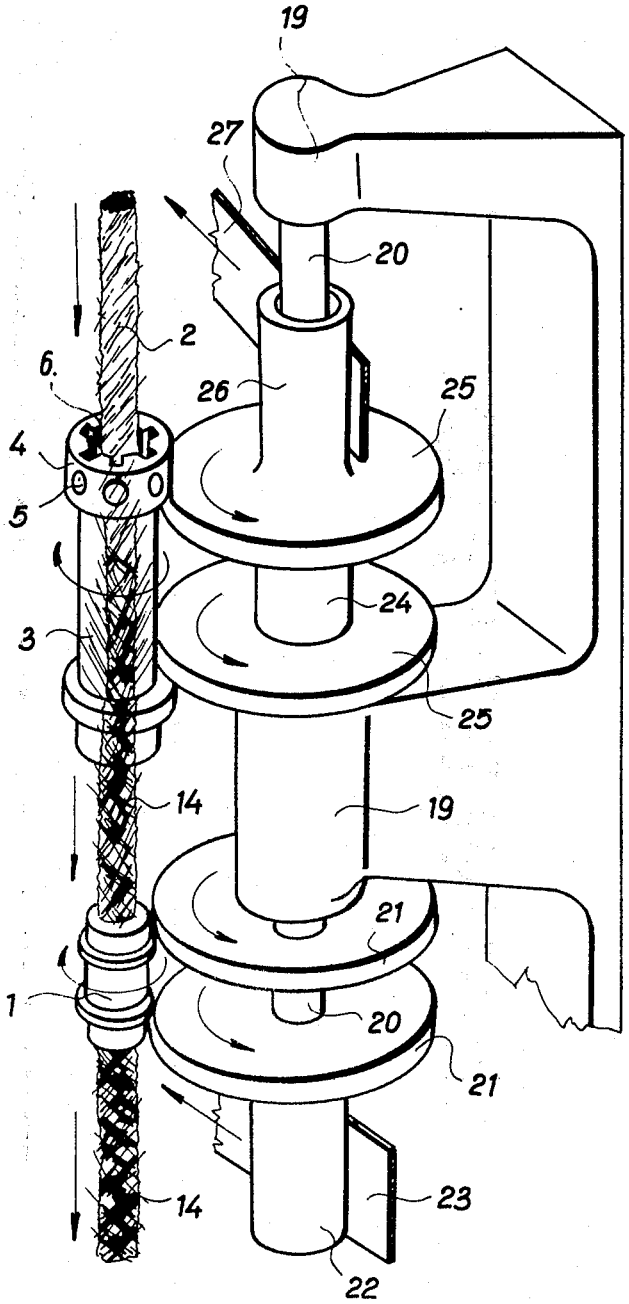
FIG. 1 is a view in perspective of a spinning unit according to the present invention.

As shown in FIG. 1, the spinning unit according to the present invention includes a false twist imparting element 1, rotating in the direction of the arrow, by means of which false twist is imparted to the staple fibers of the fiber ribbon 2 passing therethrough. A respinning twist imparting element 3 is located upstream of said false twist imparting element 1; said fiber ribbon 2 passes through element 3, which rotates in the same direction as false twist imparting element 1 but at a higher, controllable speed. On the respinning twist imparting element 3, at its inlet opening 33, there is arranged a headpiece 4 having ventilation openings 5, by means of which there is sucked off the fiber ribbon surface air together with impurities. The inner space 13 of the respinning twist imparting element 3 is provided with respinning grooves 6. If separation of short staple fibers from the fiber ribbon is to be performed, e.g., when manufacturing "combed" yarns from material for carded yarns, the respinning twist imparting element 3 is provided with longitudinal openings 1 (FIG. 3), through which there are withdrawn both short staple fibers and impurities. The length 8 of the longitudinal openings 7 is in accordance with the predetermined length of the short staple fibers to be separated. In that case, the respinning twist imparting element 3 (see FIG. 5) is arranged inside a sleeve 9, through the longitudinal openings 7 of which there are separated both the short staple fibers and impurities in the direction of the arrows and carried away by the air flow from the spinning unit.

Figure 7:
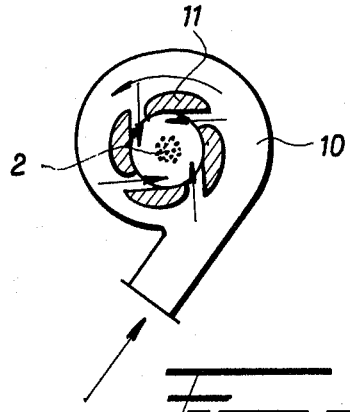
FIG. 7 is a view in cross section through an embodiment of the respinning pressure twist imparting nozzle which is provided with baffles.

As shown in FIG. 7, the respinning twist imparting element 3 can be replaced by a respinning twist imparting pressure nozzle 10, in which compressed air is directed by baffles 11 in the direction of false twist and the thus twisted fiber ribbon 2. The blade-shaped baffles 11 can, moreover, rotate in the direction of imparting false twist. A pressure air nozzle 28 (FIG. 8) for preliminary twist may be also prearranged in the direction of passage of the fiber ribbon to the respinning twist imparting element 3, said nozzle being used for lifting the staple fiber ends from the fiber ribbon 2, in which the fibers are twisted by false twist, and their introduction into the respinning grooves 6 of the respinning twist imparting element 3.

The respinning grooves 6 can have various cross sections and are directed either in the direction opposite to the rotation of the respinning twist imparting element 3, tangentially to the surface of fiber ribbon 2, thus being enabled to be used in one twisting direction, or radially towards the surface of the respun fiber ribbon 2, thus being capable of being used for both twisting directions. As shown in FIG. 4B, the respinning grooves 6 can be replaced by steel strings 12, which are stretched parallel to the fiber ribbon 2 twisted by false twist, said strings 12 being guided inside the inner space 13 of the respinning twist imparting element 3.

The spinning unit according to the present invention thus consists of at least two mutually independent elements which are mutually complementary in their function, i.e., the element 1 for continuously imparting element 3, which rotates in the same direction as element 1 but always at a different, substantially higher, speed.

Furthermore, as shown in FIG. 2, element 1 for false twist imparting may be provided with a clamping element 15, swingable about pivot 16 located in the false twist element 1. By rotation of said false twist element 1, centrifugal force is created, which acts in the direction of the arrow (FIG. 2) on the clamping element 15, and which presses the fiber ribbon 2 passing through the false twist element 1, against the supporting surface 150 of the clamp inside the false twist element 1. Consequently, the false twist is transferred directly to the compressed fiber ribbon 2, without preventing the passage of the fiber ribbon 2, respun to yarn, towards a cross-wound bobbin, such as that shown at 54 in FIGS. 12, 22, and 23, onto which said yarn 14 is wound.

Figure 6:
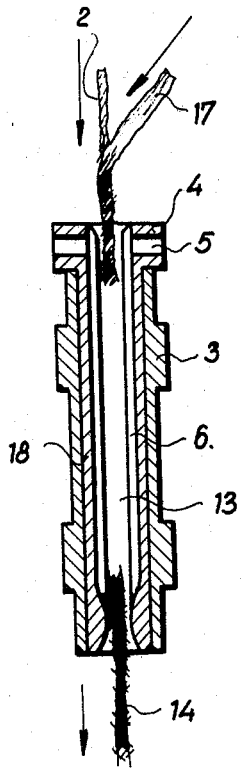
FIG. 6 is a view in longitudinal section through another embodiment of the respinning twist imparting element.

According to the present invention, the fiber ribbon 2 surface according to FIG. 6 can be wrapped, by action of false twist, by fibers in the form of a spiral from at least one additional staple fiber bunch 17. In that case, yarn 14 is formed by respinning the staple fiber bunch 17 and the fiber ribbon 2 can be formed of staple fibers of optional length of several kinds, possibly even of filaments. For increasing the efficiency of straightening the staple fiber ends, which are always directed in a direction opposite to the rotation of the respinning twist imparting element 3, the inner body 18 with respinning grooves 6 in the respinning twist imparting element 3 is made of a material which forms an electrostatic charge by friction of the rotating fibers. Consequently, the ends of the staple fibers in the false twisted fiber ribbon 2 are attracted to the inner surface of the respinning twist imparting element 3, which is provided with respinning grooves 6.

As shown in FIG. 1, the spinning unit, which consists of an element 1 for imparting false twist and of a respinning twist imparting element 3, is driven by a driving mechanism consisting of a support body 19, in which there is a rotatably mounted shaft 20, on which there are mounted driving elements 21 for driving false twist element 1 by friction. Shaft 20 is driven by a driving pulley 22 by means of a belt 23. On shaft 20 there is pivotally a bearing bushing 24 on which there are arranged driving elements, e.g., friction discs 25, for driving the respinning twist imparting element 3, made, for example, in the form of a magnetic spindle, said friction discs 25 being driven by a driving disc 26 and a belt 27. The speed of rotation of the respinning element 3 is higher than that of the false twist element 1, both speeds being controllable independently of each other.

Figure 8:
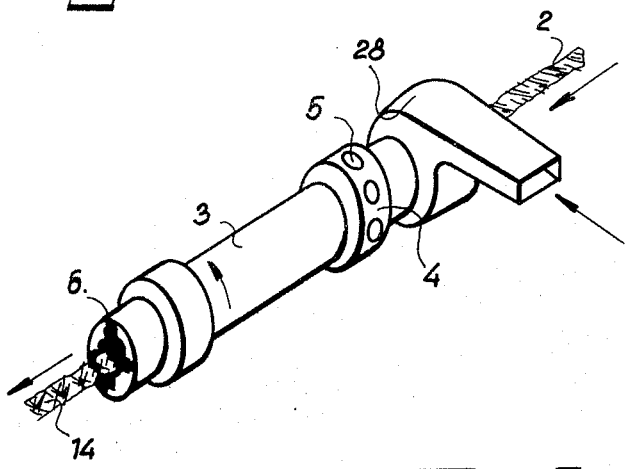
FIG. 8 is a view in perspective of an embodiment of the respinning twist imparting element which is provided with a pressure nozzle for preliminary twist.

In FIG. 8 there is shown a respinning twist imparting element 3 with a closed casing and a prearranged pressure air nozzle 28 for a preliminary twist.

Figure 9:
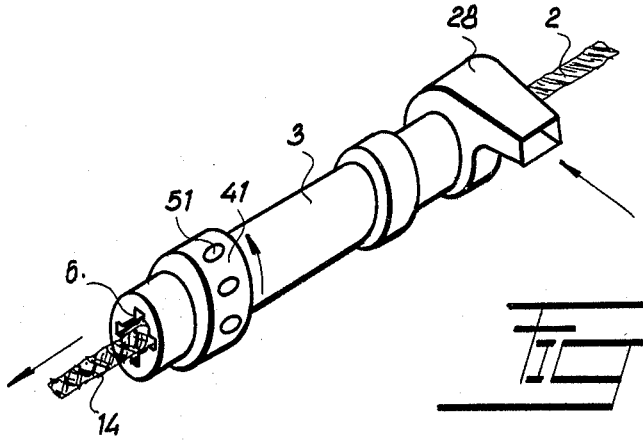
FIG. 9 is a view in perspective of an embodiment of the respinning twist imparting element which is provided with a pre-arranged pressure nozzle for preliminary twist, this being a modification of FIG. 8.

FIG. 9 illustrates a respinning twist imparting element 3 with a prearranged pressure air nozzle 28 for preliminary twist, as shown in FIG. 8. The embodiment of FIG. 9 is, however, provided with a headpiece 4 with ventilation openings 5, said element 3 being arranged on the outlet opening of the respinning twist imparting element 3, by means of which there is created a rotating pressure air flow along the whole length of the respinning twist imparting element 31.

Figure 10:
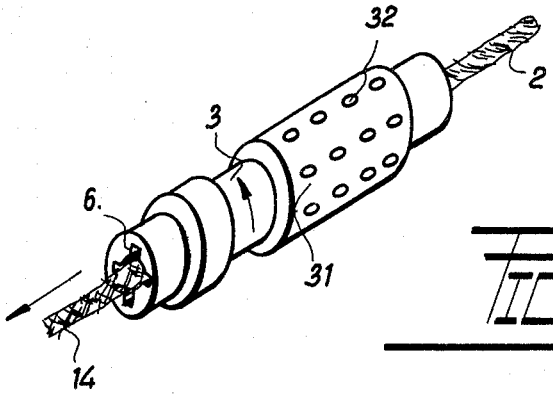
FIG. 10 is a view in perspective of an embodiment of the prespinning twist imparting element provided with a cylinder and radial openings.

FIG. 10 shows a respinning twist imparting element 3, in which a roller 31 is arranged with a plurality of rows of radial openings 32. This arrangement makes it possible to find and grip the ends of the staple fibers from fiber ribbon 2 in an improved manner during a longer passage through the respinning twist imparting element 3.

Figure 11:
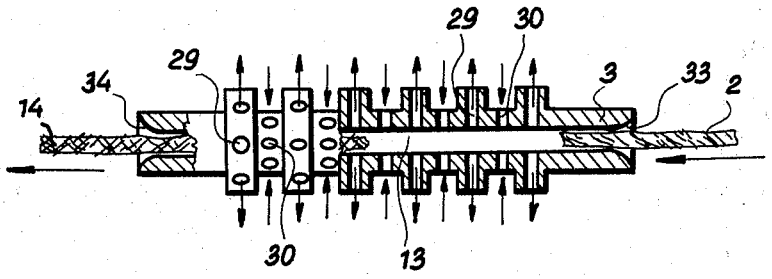
FIG. 11 is a view in partial longitudinal section through an embodiment of the respinning twist imparting element which is provided with alternatingly arranged suction openings and openings for pressure air.

In FIG. 11 there is shown a further embodiment in the form of an example of the respinning twist imparting element 3, in which at least a part of its overall length is surrounded by a certain number of suction openings 30 and openings for pressure air 29 which open into an inner space 13, the outer area of suction openings 30 being about 50 percent smaller than the outer area of openings 29 for pressure air. This arrangement makes possible an alternating sucking and withdrawing of air in the directions of the air flowing represented by the arrows in FIG. 11. By reason of the rotation of respinning twist imparting element 3, a substantially higher overpressure is created in openings 29 for pressure air.

Figures 12, 13:
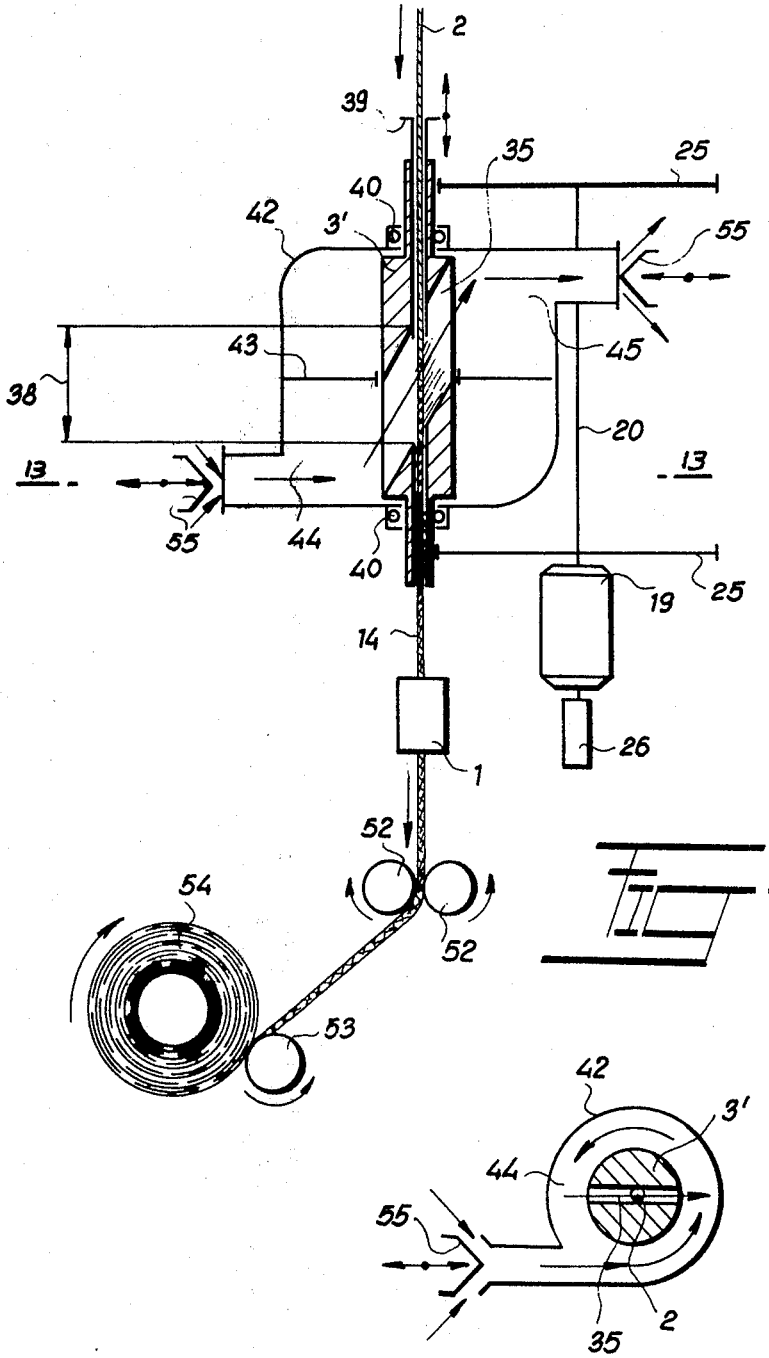
FIG. 12 is a view in cross section through the embodiment of the spinning unit according to the present invention which is adapted for operation by means of a pressure fluid.
FIG. 13 is a schematically shown cross section taken along line 13—13 in FIG. 12.

In the embodiment of FIG. 12, the spinning unit according to the present invention consists of an independently rotating respinning twist element 3', surrounding a fiber ribbon 2, a respinning channel 35 crossing the passing fiber ribbon 2 in the respinning zone 38. The respinning zone 38 can be modified by limiting elements 39 of the respinning zone to a large extent to the given staple length of the fibers to be processed. The respinning twist element 3 rotates in a bearing, e.g., a ball bearing 40, and is driven accordingly, e.g., by friction discs 25 or by a high frequency motor (not shown), etc. The friction discs 25 are press fitted on shaft 20, which is rotatably mounted in a bearing body 19 and driven by, e.g., a driving disc 26. The respinning twist element 3' can also be made in the form of a magnetic spindle, driven by friction discs 25, which is held by a magnet 41 at the circumference of the friction discs. The respinning twist element 3' according to FIG. 12 is surrounded by a box 42 for the pressure fluid, box 12 being divided by a baffle 43 into a lower part with the pressure fluid supply 44 and a further upper part with a pressure fluid delivery 45, the said parts of the box being connected only by the respinning channel 35 of the respinning twist element 3'. The pressure fluid can be either a gas or a liquid.

When using a liquid as pressure fluid, this embodiment can be used advantageously even for wet spinning, particularly when processing bast fibers, carpet yarns, etc. Upon yarn forming respinning in the respinning zone 38, yarn 14 obtains, upon passing through the false twist element 1 by the still existing and regressively formed residual false twist, an additional true twist, and the ready yarn 14 is withdrawn by means of withdrawing rollers 52 and wound by means of winding roller 53 onto the yarn bobbin 54. The false twist element 1 can be made in known manner, as e.g. a magnetic spindle, a nozzle or various rolling elements, always independently controllably driven in the direction of rotation of respinning twist element 3' and imparting to the staple fibers of fiber ribbon 2 a false twist at a lower speed relative to the respinning speed of the respinning twist element 3.

Figure 14:
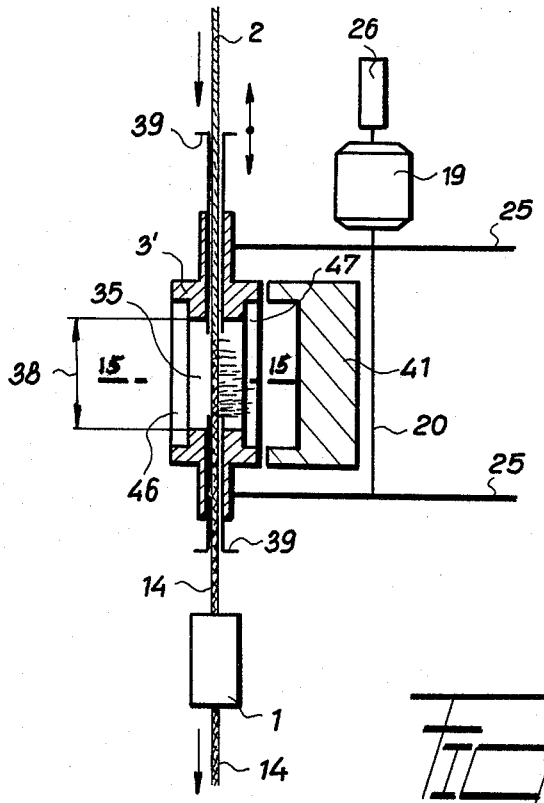
FIG. 14 is a view in cross section through another spinning unit according to the present invention in which the flowing of the pressure fluid is caused by rotating separating sections of the respinning twisting element.

As shown in FIG. 14, the respinning twist element 3' can be made in such manner, that it is provided with appurtenantly inclined separating profiles 46,47 forming a pressure flow, which supply the fluid by the rotating respinning twist element 3' from space 48 of pressure fluid via the separating profile 46 inclined into the given direction of rotation, together with its overpressure zone 49, under pressure into the respinning channel 35 and which suck off said fluid by the inclined separating profile 47 with its under pressure zone 50. Upon opposite direction of rotation of the respinning twist element 3', the separating profiles 46,47 interchange their functions, i.e. the separating profile 47 constitutes the overpressure zone 49 and the separating profile 46 the under pressure zone 50.

Figure 18:
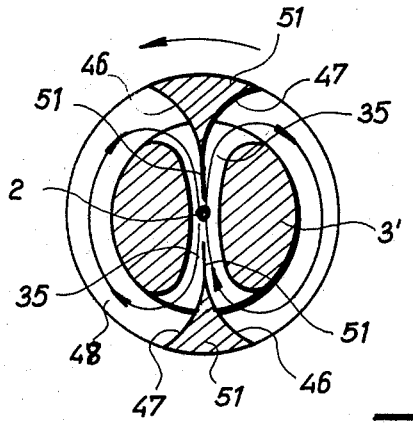
FIG. 18 is a view in cross section through a respinning twist element with bilaterally arranged deflecting sections.
Figure 19:
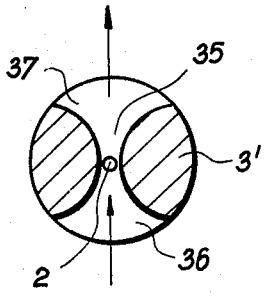
FIGS 19 to 21 are views in cross section through the respinning twist element with sections of the respinning channel formed in different manners.

As shown in FIG. 18, said separating profiles 46,47 can be arranged on the respinning twist imparting element 3' on both sides, as the diverting profiles 51, in such manner, that in the respinning channel 35 there occur two partial pressure fluid flows moving towards each other and towards the fiber ribbon 2, such flows being separated from each other by the diverting profiles 51. The said diverting profiles 51, reaching as far as the fiber ribbon, also support mechanically the respinning of the fiber ends in the appurtenant partial pressure fluid flows. By the corresponding shaping of the overall profile of the respinning channel there are created optimum conditions, on the one hand for an inlet of the pressure fluid without vortices, and on the other hand for processing a great number of different kinds, properties, and deniers of fibers and staple lengths, etc.

Figure 22:
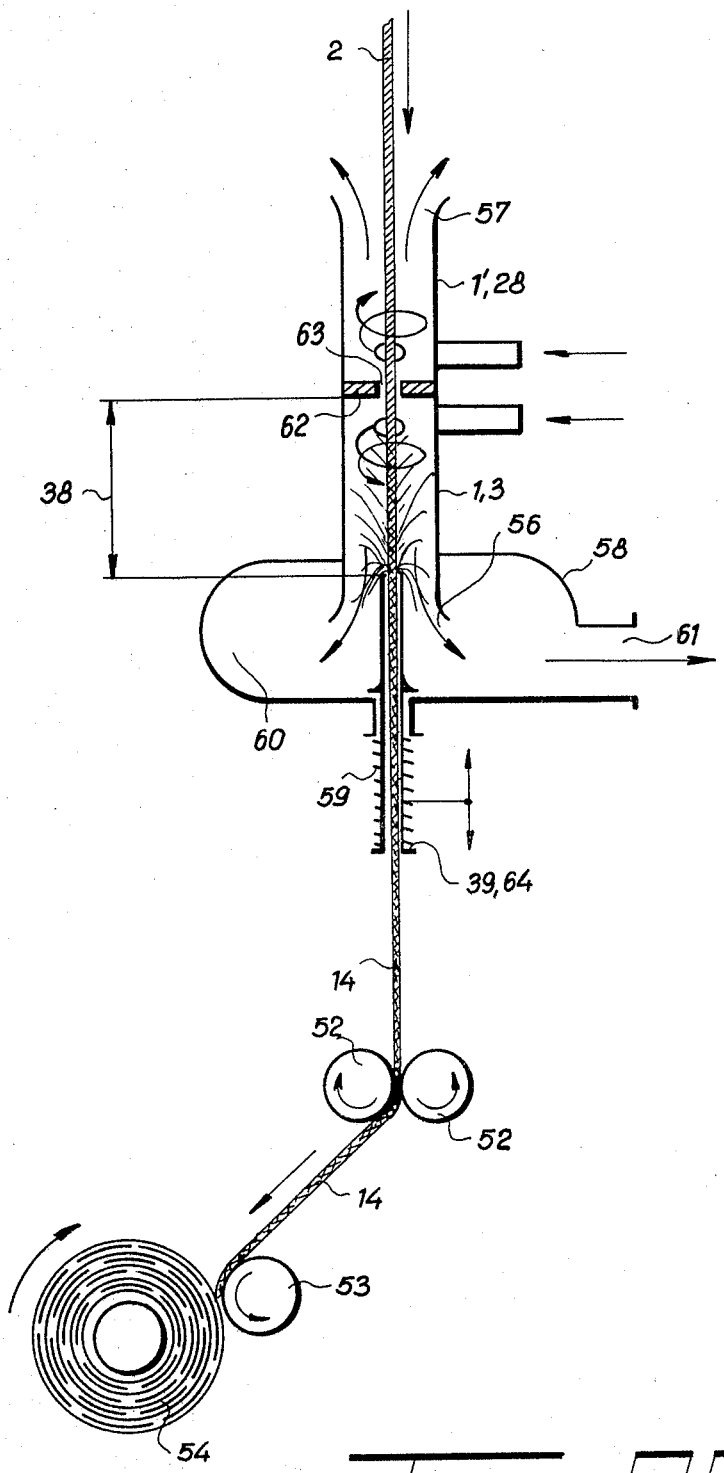
FIG. 22 is a view in cross section through the pressure spinning unit.

In the embodiment of FIG. 22, the spinning unit according to the present invention consists of a respinning pressure nozzle 1,3 imparting simultaneously a false twist and surrounding the fiber ribbon 2, an auxiliary pressure twisting element 1', 28 being comgined with said nozzle. The outlet 56 of pressure fluid of the respinning pressure nozzle 1,3 imparting simultaneously a false twist, opens into a collecting space 60 of the suction box 58, which is provided with a withdrawing opening 61. The respinning zone 39 can be modified by a limiter 39 of the respinning zone to the given staple lengths. The limiting element 39 of the respinning zone can be telescope-line engaged, as far as the transverse wall of the respinning pressure nozzle 1,3 imparting simultaneously false twist, and can use return spring 59 and thus can also be used as a yarn threading mechanism 64 for restarting the spinning unit. Upon yarn forming respinning in the respinning zone 38, the formed yarn 14 is withdrawn by withdrawing rollers 52 and wound by winding cylinder 53 onto yarn bobbin 54.

Figure 23:
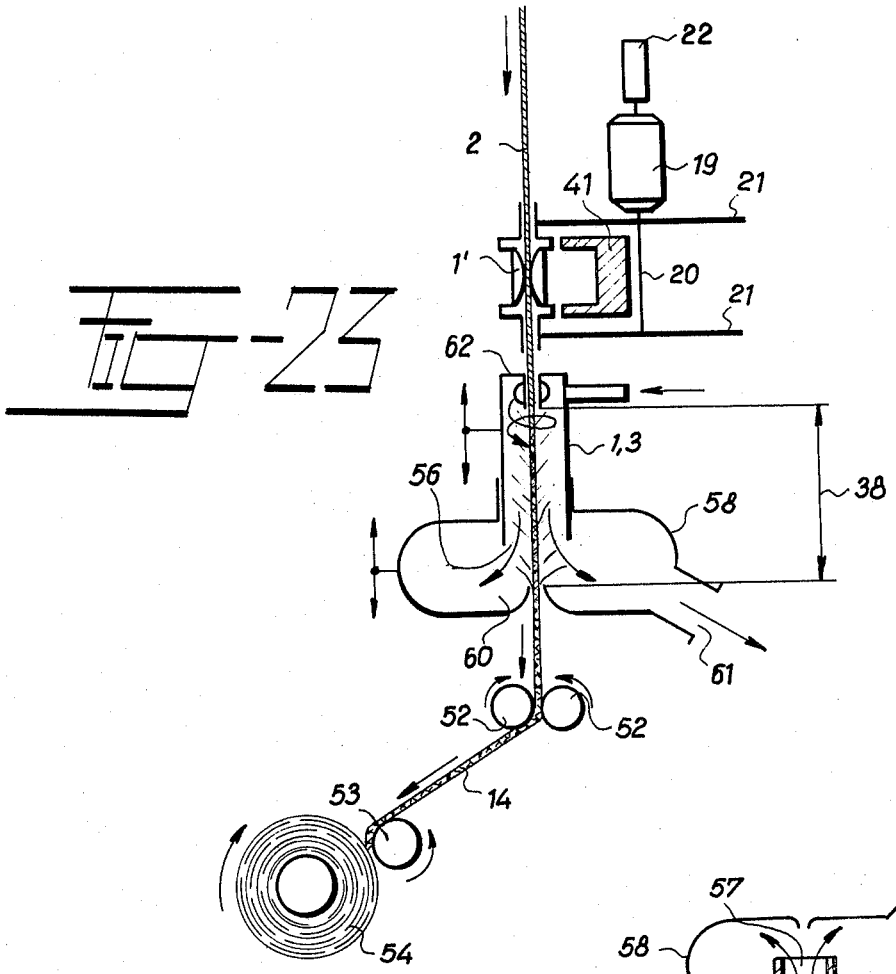
FIG. 23 is a view in cross section through a spinning unit, in which the auxiliary twister is made in the form of a magnetic spindle driven by friction discs.

As shown in FIG. 23, the auxiliary twist element 1' may be also made as a magnetic spindle driven by friction discs 21, element 1 being held on the surface of the friction discs by magnet 41. The friction discs 21 are pressed on shaft 20, which is rotatably mounted in bearing element 19 and is driven, e.g., by a belt driven pulley 22.

Figure 24:
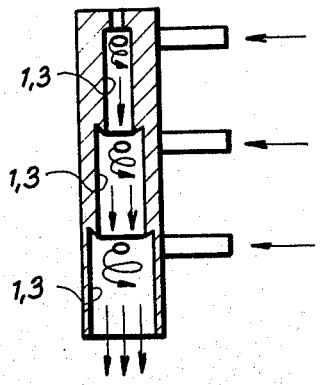
FIG. 24 is a view in cross section through an embodiment in which the respinning pressure nozzles, which also impart false twist, are arranged in sequence.

As shown in FIG. 24, the respinning pressure nozzle 1,3 which imparts simultaneously false twist, is formed for long staple fibers of a fiber ribbon 2 in such manner that it represents a plurality of independent respinning pressure nozzles 1,3 imparting simultaneously false twist, gradually widening and operating in the same direction of pressure fluid flow.

Figure 25:
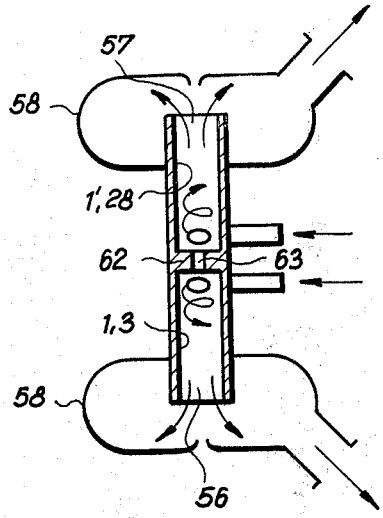
FIG. 25 is a view in cross section through an embodiment of the pressure spinning unit which uses liquid as a pressure fluid.

In FIG. 25 there is shown a pressure spinning unit, advantageous from the view of its price, such unit consisting of a tube, divided into two parts by a transverse wall 62 with an opening 63 for the yarn in its center. When using a liquid as the pressure fluid, a suction box 58 is also arranged at the outlet 57 of the pressure fluid from the auxiliary pressure twist element 1', 28.

The manner in which the apparatus according to the present invention is operated will now be explained.

In the embodiments shown in FIGS. 1 to 11, inclusive, false twist is imparted to the staple fibers of the fiber ribbon 2 by rotation of false twist element 1. The front ends of the staple fibers are always directed on the surface of the fiber ribbon 2, twisted by false twist, in the direction of imparting false twist, i.e. in the direction of rotating false twist element 1, the front end of the staple fibers being neither retained, nor otherwise influenced by the means of the respinning twist imparting element 3, rotating a higher speed. All staple fiber front ends passing through the respinning twist element 3 can be deposited only in the direction of imparting false twist on the surface of the false twisted fiber ribbon 2. The ends of the staple fibers are directed, by imparting false twist to the fiber ribbon 2, in a direction opposite to the false twist. Thus, they can be continuously lifted from the surface of the fiber ribbon 2 and gripped by overpressure or underpressure, attraction by electrostatic charge or mechanically, e.g. the respinning grooves 6, or a combination of the above said means.

The gripped ends of the staple fibers are gradually partially released by unwinding, whereby further stable fiber ends from the false twisted fiber ribbon 2 get on the surface and are lifted and gripped in a similar manner and again unwound by the speed of the respinning twist imparting element 3, and a true twist is imparted thereto upon its passing again through the respinning twist imparting element 3. Both speeds, i.e. the speed of false twisting element 1 and the speed of respinning twist element 3 are adjusted to the given staple length of the fibers to be spun in such manner that full unwinding cannot take place in the respinning twist element 3, nor releasing of the fibers. This is secured by an appurtenantly selected twisting zone of the respinning twist imparting element 3, e.g., the respinning grooves 5.

The twisting zone of the respinning twist imparting element 3 consists of an unwinding zone and usually of a respinning zone. In the unwinding zone, the passing staple fiber ends are lifted, gripped and unwound; upon further passage through the respinning twist imparting element 3 a true twist is imparted to them in the following respinning zone. That means that after the passage of the fiber ribbon 2 twisted by false twist, through the respinning twist imparting element, the formed yarn 14 has in its core a residual false twist from that originally imparted, while its surface is respun in the major part of the staple length in the direction of imparting false twist for imparting true twist. In the yarn section between the respinning twist imparting element 3 and the false twist element 1, yarn 14 has in its core a residual false twist, which is reconstituted upon passage of the yarn through element 1 to an additional false twist, yarn 14 thus having an even character and being enabled to be continuously withdrawn to a cross-wound bobbin.

During respinning of staple fibers these can freely rotate about their axis, so that yarn 14 is stable and has no tendency for loop forming, as do the conventionally manufactured yarns. If, in consequence of the unwinding and respinning as described above, a complete releasing of substandard short staple fibers from the fiber ribbon 2 is achieved, said fibers can be removed through longitudinal openings 7 from the respinning twist imparting element 3, the yarn 14 without these fibers has the character of combed yarn. Alternatively, with a closed housing, the released short fibers are continuously gripped and brought to the yarn forming fiber ribbon by the unwound and respun ends of longer staple fibers held, e.g., in the respinning grooves 6 in the respinning twist imparting element.

The continuous yarn formation is thus influenced by the following parameters: length of staple fibers, twisting zone of respinning twist imparting element 3, mutual velocity ratio of the respinning twist imparting element 3 and the false twist element 1, rotating in the same direction, and the withdrawing speed of the fiber ribbon 2 passing therethrough.

The apparatus according to the present invention in the embodiments shown in FIGS. 12 to 21, inclusive, operates as follows:

The staple fibers of the fiber ribbon 2 are given an adequate reinforcing false twist by the false twisting element 1, this being the basic precondition for the operation of yarn forming respinning by twisting. Thereby, the front ends of the separate staple fibers of the fiber ribbon 2 are directed in the direction of false twist, and their rear ends are directed in the opposite direction. The fiber ribbon 2 is crossed in the respinning zone 34 of respinning channel 35 by the flowing pressure fluid. In the respinning channel 5 of the rotating respinning twist element 3', in view of the passage of the fiber ribbon 2 therethrough, both the coacting respinning direction and the intensity of respinning of the pressure fluid are adjustable independently of each other, or controllable, respectively. The staple fiber ends of the passing fiber ribbon 2, lifted by the pressure fluid and gripped, are partially released by unwinding in the direction of false twist against false twist by a higher speed and, upon further passage through the respinning twist element 3', in the same direction during twist impartment, are rewound onto the fiber ribbon 2, said fiber ribbon 2 thus obtaining by the respinning twist element 3' upon further passage a true twist, i.e., a yarn forming twist, while in said respinning twist element 3' in the false twist direction, the front ends of the staple fibers thus directed remain only deposited on the fiber ribbon 2. The yarn 14 thus spun obtains upon passage through the false twist element 1 by the still pertaining and reconstituted false twist a further true twist, and the finished yarn 14 is withdrawn by withdrawing rollers 52 and wound onto yarn bobbin 54 by means of a winding roller 53.

A characteristic property of a yarn 14 thus spun consists in the fact that yarn 14 cannot untwist itself, this being due to the gradual twist imparting. Upon forming yarn, there is also another favorable factor consisting in that the separate staple fibers constantly remain in a stretched condition. This is caused on the one hand by the original false twist imparted to the fiber ribbon 2, and on the other hand by the flowing of pressure fluid upon respinning twist imparting. As a result, said undetwistable yarn 14 has a high strength, a perfect appearance and excellent eveness. The gradually performed twisting and the circumstance that the staple fiber ends can rotate freely about their axes during respinning ensure that the formed yarn 14 has no loops, so that the hitherto frequently necessary preliminary treatment of yarn, as for example steaming, need not be performed.

The intensity of the pressure fluid flow in the respinning channel 35 can be controlled by controlling the pressure, e.g., by orifice plates 55 or by suction in the pressure fluid supply 44, as well as in the pressure fluid delivery 45. The pressure fluid box 42 is divided by a partition wall 43 into the pressure fluid supply 44 and the pressure fluid delivery 45, and these parts of the pressure fluid box are connected merely by the rotating respinning channel 35 of the respinning twist element 3'. A rotative respinning twist element 3' with separating profiles 46,47 or diverting profiles 51 engaging the operative space 48 of pressure fluid and forming a flow, may also be used. Thus, for example, it is possible to secure the pressure fluid control in a pressureless fluid supply by different suction in the fluid delivery 45. The pressure difference between the pressure fluid supply and the pressure fluid delivery can also be additionally influenced by pressure flow creating separating profiles 46,47 or by diverting profiles 51.

For a more delicate processing of staple fibers of higher denier values, a respinning twist element 3' with ventilation openings 5 (FIG. 16) may be used. According to the rotation of the respinning twist element 3' a smaller or greater pressure fluid flow is created in the respinning channel 35, which can be still additionally controlled by suction, conducted via sleeve 9 outside the spinning unit. Upon spinning yarn from staple fibers of coarse denier values, with which a more difficult respinning twisting operation must be taken into account, it is advantageous to use the respinning twist element 3' with diverting profiles 51 acting bilaterally. By this arrangement, two partial pressure fluid flows are created, which move against each other towards the fiber ribbon 2, and are moved to said fiber ribbon separated from each other, the respinning intensity of the pressure fluid being mechanically enhanced thereby to a substantial extent.

A further advantage of the spinning unit according to the present invention consists in the possibility of withdrawing by means of the pressure fluid flow, during respinning, the completely released staple fibers of substandard length out of the spinning unit, and thus to manufacture from a carded fiber ribbon 2 yarn 14 of combed character or, to return these released staple fibers to the yarn forming fiber ribbon 2 in the respinning zone 38 and spin them in. The length of the staple fibers of substandard length, which have to be released during respinning and separated, can be defined to a great extent by adjustment of the respinning zone 38, e.g., by limiting elements 39 of the respinning zone, in dependence upon the adjustable speed of rotation of the respinning twist element 3', the speed of passage of the fiber ribbon 2, and the adjustable pressure fluid flow in the respinning channel 35.

Figure 15:
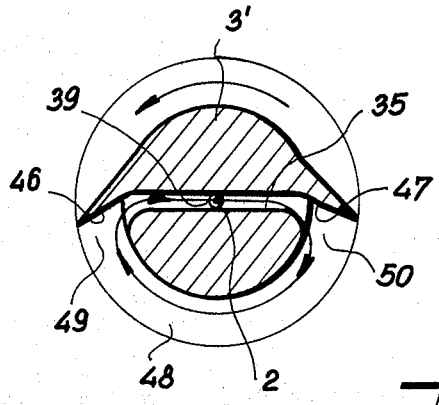
FIG. 15 is a view in cross section along line 15—15 in FIG. 14.
Figure 16:
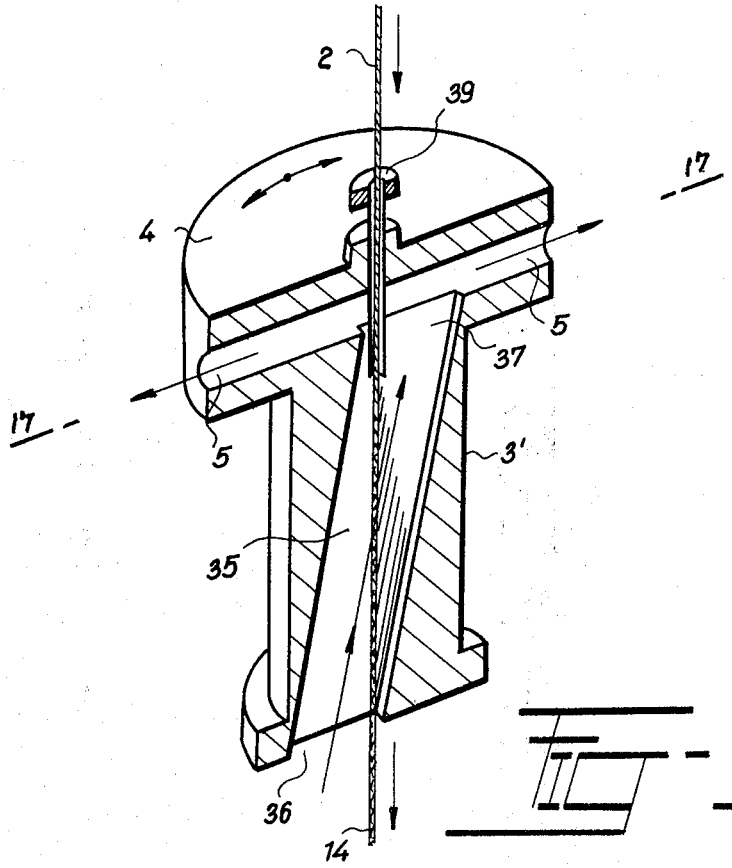
FIG. 16 is a view in cross section through a third spinning unit according to the present invention, shown in perspective, in which the pressure fluid flow is evoked by a headpiece of the respinning twist element, provided with ventilation openings.
Figure 17:
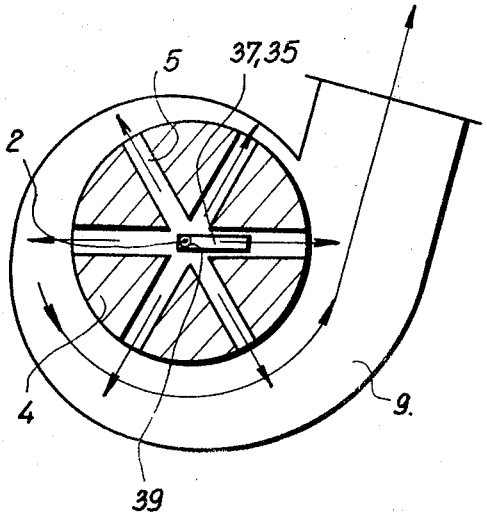
FIG. 17 is a view in cross section along line 17—17 in FIG. 16 with a sleeve represented in addition.

When the released staple fibers of substandard length are to be returned to the fiber ribbon 2, the respinning twist element 3' is to be formed, as shown in FIG. 14, with a respinning channel 35 situated in one plane approximately, so as to form a closed cycle of pressure fluid flow (FIGS. 15 and 16). The released fibers move from the underpressure zone 49, or 50, back to the overpressure zone 50, or 29, as the case may be, of the separating profiles 46 or 47, or the diverting profiles 51, and are again entrained by the pressure fluid towards the staple fibers of fiber ribbon 2 into the respinning channel 35 and spun into the yarn forming fiber ribbon 2. This closed cycle flowing of the pressure fluid is supported upon its creation and is also maintained by the direction of rotation of the respinning twist element 3'. In this closed cycle, this is controllable, e.g., by orifice plate 55, the impurities of the fiber ribbon 2, released during the respinning twisting by centrifugal effect, are separated in the operation space 48 of the pressure fluid from the circulating flow of the pressure fluid and delivered by known means outside the spinning unit. Upon using a respinning twist element 3' with separating profiles 46,47 as shown in FIG. 15, or with diverting profiles 51 as shown in FIG. 18, which are arranged on the surface of the respinning twist element 3' in different, not represented, planes and between which is arranged in a predetermined angle value a respinning channel 35, a closed cycle of pressure fluid may arise and, during respinning twisting released staple fibers of substandard length can in this case be delivered only outside the spinning unit.

Figure 20:
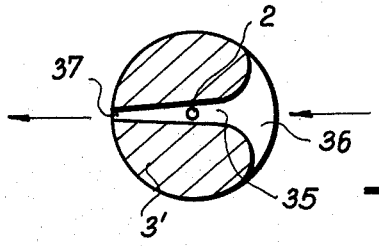
Figure 21:
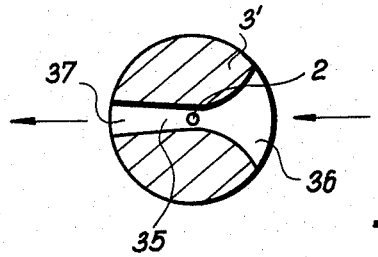

In FIGS. 18 to 21, inclusive, various profiles of the respinning channel 35 to be used are shown in form of examples. In FIGS. 20 and 21 there are shown cross sections of profiles with a unilateral pressure fluid flow, and in FIGS. 18 and 19 there are shown cross sections with a bilateral pressure fluid flow.

As already stated before, the respinning twist element 3' must always rotate in the same direction, but at a higher speed relative to the false twist imparting. Upon respinning in a rotating respinning channel 35, the coacting pull of the pressure fluid can simultaneously continuously impart to the fiber ribbon 2 during respinning an irregularly varying, uncontrollable false twist, said varying being continuously eliminated by a regularly and controllably driven false twist element 1, the respinning thus being performed undisturbed, under the most suitable predetermined conditions.

The above specified possibilities, including their arbitrary combinations, give the spinning unit as shown in FIGS. 12 to 21 a great versatility in adapting to various conditions and processing of various kinds of biers.

The device according to the present invention, as shown in FIGS. 22 to 25, operates as follows:

The pressure fluid, supplied continuously for the purpose of respinning into the respinning element 3 in the direction of the arrow, bypasses the passing fiber ribbon 2 helically in the direction of the arrow to which there is thus continuously imparted a false twist, respinning element 3 thus acting simultaneously as a false twist element 1, and operating in this manner as a respinning pressure nozzle 1,3 which simultaneously imparts false twist. By thus imparting false twist, the front ends of the staple fibers of the fiber ribbon 2 twisted on the surface by false twist, are always continuously directed into the direction of false twist imparting, i.e., in the direction of rotation of the pressure fluid of the respinning pressure nozzle 1,3. Imparting simultaneously false twist, said front ends of staple fibers being in no manner gripped or otherwise influenced by the respinning speed of the supplied pressure fluid, which is higher than the speed of false twist imparting. All front ends of the staple fibers, which pass through the respinning pressure nozzle 1,3 imparting simultaneously false twist, can be deposited on the surface of the fiber ribbon 2 twisted by false twist only in the direction of false twist imparting. The ends of the staple fibers of the fiber ribbon 2 are directed by this false twist imparting in the opposite direction of false twist imparting, i.e., in the direction opposite to the rotation of the pressure fluid in the respinning pressure nozzle 1,3 imparting simultaneously false twist, and thus influenced thereby on the surface of the fiber ribbon 2.

Since this false twist imparting by the bypassing pressure fluid is very effective, as known for example from texturing by pressure air, and the excessively twisted surface of the fiber ribbon 2 is closed for lifting the fibers and their following respinning, as mentioned before, this high false twist is controllably and continuously reduced by the prearranged auxiliary twisting element 1',28 to a level which is suitable for respinning. This reduction of the false twist is at the same time continuously transferred in a reinforcing manner to the fiber ribbon 2 entering the spinning unit. Thus, the fiber ends of the ribbon 2 are continuously lifted by the rotating respinning pressure fluid flow in the respinning pressure nozzle 1,3, imparting simultaneously false twist, from the surface of the fiber ribbon 2 in the respinning zone 38 of the spinning unit, gripped and unwound in the direction of false twist from the passing fiber ribbon 2 and partially released against false twist imparting at a higher speed, the fiber ribbon 2 obtaining upon further passage through the respinning pressure nozzle 1,3 simultaneously imparting false twist, a true twist, whereby yarn 14 is formed.

The spun yarn 14 obtains, upon passage through the respinning pressure nozzle 1,3, imparting simultaneously false twist, a still pertaining and regressively formed false twist, which was not reduced by an auxiliary twist element 1',28, and the finished yarn 14 is withdrawn by means of withdrawing rollers 52 and wound onto yarn bobbin 54 by means of winding roller 53.

The respinning zone 38 determines (defines) the length of the passing fiber ribbon 2, on which the fibers are lifted, gripped and the staple fiber ends are unwound in the respinning pressure nozzle 1,3 imparting simultaneously false twist. The beginning of wrapping is simultaneously the beginning of the yarn formation, at which the fiber ends in stretched condition are entrained by the rotating pressure fluid flow and wound in a yarn forming manner around the passing fiber ribbon 2, whereupon the latter is transformed to yarn 14.

For the purpose of creating optimum winding conditions in respinning relative to the length of the staple fibers in fiber ribbon 2, and for preventing a possible undesired releasing of staple fibers, the respinning zone 39 is adjustably defined by limiting element 39 of the respinning zone, which also defines the beginning and the point of the wrapping process of the unwound staple fiber ends in the fiber ribbon 2 about the latter.

The respinning zone 38 can also be defined by the controllable attachment of suction box 58 to the respinning pressure nozzle 1,3 imparting simultaneously false twist, in the suction box 58 (FIG. 23).

Upon starting the spinning process in the spinning unit, the limiting element 39 of the respinning zone can be simultaneously used as a yarn threading mechanism 64, if it is arranged in such manner that it can reach by means of a return spring 59 as far as the transverse wall 62. When the spring 59 holds the limiting element 39 of the respinning zone in an adjusted position, the same serves the purpose of a limiting element 39 of the respinning zone. However, if the yarn 14 is to be drawn through the spinning unit, then the limiting element 39 of the respinning zone is telescopically pressed as far as transverse wall 62, thus serving the purpose of a yarn threading mechanism 64.

By suction evoked on the other side of opening 63 for yarn which is created, e.g., by introducing pressure fluid into the auxiliary twisting element 1',28, such suction is transferred into the inner space of yarn threading mechanism 64, and yarn 14 is thus drawn via suction box 58 and via respinning pressure nozzle 1,3 imparting simultaneously false twist through opening 63 for the yarn. The drawn yarn 14 is twisted to the fiber ribbon 2 and the spinning unit is prepared for the spinning process.

Upon processing coarse yarns, a mechanical auxiliary twist element 1' (see FIG. 23) may be used, which is prearranged relative to the respinning pressure nozzle 1,3 imparting simultaneously false twist, since this auxiliary twist element has a minimum irregularity of rotation, this being advantageous for actual respinning. The core of fiber ribbon 2, weakened by respinning, must have a sufficient strength for preventing draft of fiber ribbon 2 in the auxiliary twist element 1'. Therefore, the auxiliary twist element 1' must be also arranged in front of the respinning pressure nozzle 1,3 imparting simultaneously false twist, at a shorter distance than the average length of the staple fibers in the fiber ribbon 2. It is also possible for the auxiliary twist element 1' adjustably to engage (in a manner not shown) from topside directly with its lower part, the respinning pressure nozzle 1,3 imparting simultaneously false twist in the same manner as the rotary limiting element 39 of the respinning zone.

The stepwise arrangement of the respinning pressure nozzle 1,3 imparting simultaneously false twist is intended for long staple fibers in fiber ribbon 2 (see FIG. 24), as the diminishing rotation of the respinning pressure fluid can be accelerated again in steps, so as to form in this manner an adequately long respinning zone 38, which has advantageously a length at least equal to the staple fiber length in fiber ribbon 2. This acceleration may advantageously increase in the direction of passage of fiber ribbon 2, so as to secure the most favorable stretching of the fiber ends upon yarn forming respinning.

The spinning unit of FIG. 25 is most advantageous as to its price. When using gaseous pressure fluid, a suction box 58 must be arranged at least at the outlet 56 of pressure fluid, for making it possible to take away staple fibers of substandard length, released completely during respinning, and simultaneously to remove impurities, by means of said suction box 58 from the spinning unit to a collecting contaner (not shown). When using liquid, the suction box 58 must be arranged on both outlets 56,57 of the pressure fluid, for the purpose of withdrawing it.

A characteristic property of the yarn 14 thus spun consists in the fact that it cannot become substantially untwisted by itself. This is due to the stepwise imparted twist. When forming the yarn, it is advantageous that the separate staple fibers remain almost constantly in stretched condition; this is caused on the one hand by the original false twisted fiber ribbon 2 and on the other hand by the pressure fluid flow. Thus, this undetwistable yarn 14 has high strength, perfect appearance and excellent evenness. The stepwise performed twisting, and the circumstance that the staple fiber ends can rotate freely about their axes during respinning produce a yarn 14 without loops, so that the hitherto frequently needed pretreatment of yarn, as for example, steaming, can be omitted.

All possibilities as described above in connection with FIGS. 22 to 25, inclusive, give the spinning unit according to the present invention a high versatility as to its modification to meet various conditions in processing a maximum variety of textile fibers.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. Method of break spinning yarn in a spinning machine having at least one spinning unit, comprising:

(a) continuously feeding at least one fiber ribbon to each spinning unit of the spinning machine, said ribbon consisting of staple fiber parallelized in the direction of yarn withdrawal to form a ribbon;

(b) imparting a false twist to said ribbon by a false twist imparting element, whereby the front ends of the separate staple fibers are directed in the false twist direction, and the rear ends thereof are directed in the opposite direction;

(c) lifting from the ribbon the staple fiber ends of the thus false twisted ribbon in a respinning twist imparting element which grips and partially releases the staple fiber ends in the false twist direction by a higher speed relative to the false twist imparting speed, the fiber ribbon being given a yarn forming true twist upon further passage through the respinning twist imparting element;

(d) the staple fiber front ends directed in the false twist direction remaining in the respinning twist imparting element in adjacent arrangement to the fiber ribbon;

(e) imparting an additional, true twist to the spun yarn by the remaining and regressively formed false twist; and (f) winding the finished yarn onto a cross-wound bobbin.

2. Method as claimed in claim 1, wherein the speed of false twist imparting and the speed of respinning are different from one another and are separately adjustable.

3. Method as claimed in claim 1, wherein the respinning twist zone length is at least equal to the length of the false twisted staple fiber.

4. Method as claimed in claim 1, wherein the staple fiber ends of the false twisted fiber ribbon are lifted and gripped by pressure air.

5. Method as claimed in claim 1, wherein the staple fiber ends of the false twisted fiber ribbon are lifted and gripped by pressure liquid.

6. Method as claimed in claim 1, wherein the staple fiber ends of the false twisted fiber ribbon are lifted and gripped by underpressure created in the ventilation openings in a rotating element.

7. Method as claimed in claim 1, wherein the staple fiber ends of the false twisted fiber ribbon are lifted and gripped by the respinning flow created by rotation of the respinning twist imparting element.

8. Method as claimed in claim 1, wherein the direction of the pressure fluid flow in the respinning twist imparting element crosses the direction of the passing fiber ribbon.

9. Method as claimed in claim 1, comprising continuously removing all staple fibers of substandard length which are released from the fiber ribbon.

10. Method as claimed in claim 1, wherein all staple fibers of substandard length which are released from the fiber ribbon are fed to the yarn forming fiber ribbon.

11. Method as claimed in claim 1, comprising wrapping helically the surface of the false twisted fiber ribbon by at least one additional staple fiber ribbon.

12. Apparatus for break spinning yarn, said apparatus having a spinning unit with a yarn forming zone arranged in the direction of passage of a fiber ribbon, at least one respinning twist imparting element surrounding said fiber ribbon, and a false twisting element downstream of the re-spinning twist imparting element, and means for driving the false twist imparting element and the respinning twist imparting element in the same direction and at different speeds.

13. Apparatus as claimed in claim 12, comprising a pressure air pre-twist nozzle which coacts with the respinning twist imparting element.

14. Apparatus as claimed in claim 12, wherein the respinning twist imparting element is made in the form of a pressure fluid respinning twist imparting nozzle.

15. Apparatus as claimed in claim 12, wherein the respinning twist imparting element and the false twisting element are each made in the form of at least one pressure fluid false twist imparting nozzle arranged with its pressure fluid outlet in the direction of passage of the fiber ribbon, said nozzle having an auxiliary twist imparting element controlling the false twist imparting in the respinning twist imparting zone upon respinning, said auxiliary twist imparting element being arranged in front of the pressure fluid respinning false twist imparting nozzle at a distance shorter than the average staple length of the fiber ribbon, the pressure fluid outlet of said pressure fluid respinning false twist imparting nozzle opening into a collecting enclosure of a suction box.

16. Apparatus as claimed in claim 15, comprising at least two stepwise widening pressure fluid respinning false twist imparting nozzles operating independently in the same directions of flow, are arranged behind each other.

17. Apparatus as claimed in claim 16, wherein said two stepwise widening nozzles are of cylindrical shape.

18. Apparatus as claimed in claim 15, wherein the auxiliary twist imparting element directed oppositely to the direction of passage of the fiber ribbon and the pressure fluid respinning false twist imparting nozzle are made in the form of a pressure fluid spinning unit of a tube divided by a transverse wall with a yarn opening in its center into two parts and are provided with tangentially arranged pressure fluid supplies.

19. Apparatus as claimed in claim 15, wherein oppositely to the pressure fluid outlet of the pressure fluid respinning false twist imparting nozzle there is arranged a limiting element for adjustably defining the respinning twisting zone.

20. Apparatus as claimed in claim 19, wherein the limiting element also serves the purpose of a yarn threading mechanism which is engageable telescopically as far as the transverse wall of the pressure fluid respinning false twist imparting nozzle by means of a return spring.

21. Apparatus as claimed in claim 15, wherein the inner surface of the pressure fluid respinning false twist imparting nozzle is made of a sintered ceramic material.

22. Apparatus as claimed in claim 12, wherein the respinning twist imparting element is made in the form of a rotatable respinning twist imparting body provided with a respinning channel, said respinning channel is arranged at a predetermined angle relative to fiber ribbon in such manner that the direction of the pressure fluid flow in the respinning channel crosses the direction of travel of the fiber ribbon passing through the respinning twist imparting body.

23. Apparatus as claimed in claim 22, wherein the height of the respinning channel on the fiber ribbon defines the respinning twist imparting zone, said respinning twist imparting zone being shorter than the average staple length of the staple fibers in the fiber ribbon.

24. Device as claimed in claim 22, wherein the respinning twist imparting body is provided with at least one limiting element for the twisting zone, said limiting element adjustably penetrating the respinning channel.

25. Apparatus as claimed in claim 22, wherein the respinning channel has a narrowing cross section in the direction of the pressure fluid flow at least behind the respinning twist imparting zone.

26. Apparatus as claimed in claim 22, wherein the respinning channel has a narrowing cross section from its inlet opening in the direction of the pressure fluid flow towards the fiber ribbon, and has a widening cross section from the fiber ribbon to the outlet opening of the respinning channel.

27. Apparatus as claimed in claim 22, wherein the rotating respinning twist imparting body is provided with at least one headpiece with ventilation openings distributed about its circumference, the outlet opening of the respinning channel opening into the ventilation openings.

28. Apparatus as claimed in claim 22, for the creation of the pressure fluid flow in the respinning channel, the respinning twist imparting body is provided with blade-shaped separating profiles projecting into a pressure fluid operating space, said profiles being arranged relative to the longitudinal axis of the respinning twist imparting body at a flow promoting angle.

29. Apparatus as claimed in claim 28, wherein on the respinning twist imparting body there are arranged diverting profiles, said profiles projecting into the pressure fluid operating space dividing the respinning channel as far as the fiber ribbon and forming a pressure flow.

30. Apparatus as claimed in claim 12, wherein the respinning twist imparting element is made in the form of a spindle driven by friction discs.

* * * * *